United States Patent [19]

Hirosaki et al.

[11] Patent Number: 4,744,680

[45] Date of Patent: May 17, 1988

[54] WIDE-TYPE THERMAL-TRANSFER PRINTER

[75] Inventors: Yukihiro Hirosaki; Takahiko Ohata, both of Mishima; Motonobu Hamada, Fuji; Seiji Koike, Shizuoka, all of Japan

[73] Assignee: Tokyo Electric Co., Ltd., Tokyo, Japan

[21] Appl. No.: 863,697

[22] Filed: May 15, 1986

[30] Foreign Application Priority Data

May 21, 1985 [JP] Japan ..... 60-108531

[51] Int. Cl.[4] ..... B41J 3/20; B41J 33/08

[52] U.S. Cl. ..... 400/120; 346/76 PH; 400/224.2; 400/613; 400/693.1

[58] Field of Search ..... 400/120, 613, 224.2, 400/691–693.1; 346/76 PH; 101/93.04

[56] References Cited

U.S. PATENT DOCUMENTS

| | | | |
|---|---|---|---|
| 3,707,214 | 12/1972 | Ponzano | 400/144.2 |
| 4,527,172 | 7/1985 | Nagashima | 400/120 X |
| 4,562,444 | 12/1985 | Nagashima | 400/120 X |
| 4,632,585 | 12/1986 | Oyamatsu | 400/120 X |
| 4,641,980 | 2/1987 | Matsumoto | 400/120 |
| 4,666,319 | 5/1987 | Hirosaki | 400/120 |

*Primary Examiner*—Paul T. Sewell

*Attorney, Agent, or Firm*—Frishauf, Holtz, Goodman & Woodard

[57] ABSTRACT

A wide-type thermal-transfer printer comprises a fixed mechanism section including a record medium holder mounted on one end portion of a fixed frame so as to rotatably hold a record medium rolled, and a platen mounted on the other end portion of the frame so as to carry thereon the medium from the holder, and a printer unit including a moving frame coupled to the fixed frame so as to be movable between a first position adjacent to the fixed frame and a second position remote from the fixed frame, the moving frame being fixed with a thermal head so that the head, in cooperation with the platen, holds the medium when the moving frame is located in the first position, and so that the head separates from the medium on the platen when the moving frame is moved to the second position, wherein the moving frame is detachably fitted with an ink ribbon supply shaft and an ink ribbon take-up shaft, so that the ribbon is held between the platen and the head in a manner such that the longitudinal direction of the ribbon is substantially in line with the transporting direction of the medium when the moving frame is located in the first position, and wherein the head starts printing with the medium and ribbon being moved in the same direction when the moving frame is located in the first position.

23 Claims, 10 Drawing Sheets

WIDE-TYPE THERMAL-TRANSFER PRINTER

BACKGROUND OF THE INVENTION

The present invention relates to a wide-type thermal-transfer printer in which a fixed thermal head prints with use of an ink ribbon moving relatively to the fixed thermal head.

Conventionally, a fixed thermal head whose transverse dimension is greater than its longitudinal dimension is used to print heat-sensitive paper being transported in the longitudinal direction of the head. As is generally known, a bar code is printed on a label sheet made of heat-sensitive paper having its transverse length greater than its longitudinal length. A number of such label sheets are pasted on a base sheet, longitudinally adjoining each other, and are fed longitudinally for bar-code printing so that their longitudinal direction is in line with that of the thermal head. The bar code is printed on each label sheet in a manner such that each bar of the code extends in the longitudinal direction. In the bar-code printing by means of a prior art wide-type thermaltransfer printer, however, ordinary paper (not heatsensitive) cannot be used as a material for the label sheets.

For the use of ordinary paper in the thermal-head printing, the ink ribbon used must be one which is formed by applying thermal ink to base film. However, the width of conventional ink ribbons is much narrower than the transverse length of the wide-type thermal head. Narrow ribbons cannot be used in the wide-type thermal printer.

Preferably, an ink ribbon used in the printer of this type has a width substantially equal to or more than the transverse dimension of the wide-type thermal head, and is fed longitudinally in a manner such that its longitudinal direction is in line with that of the head.

SUMMARY OF THE INVENTION

The present invention is contrived in consideration of these circumstances, and is intended to provide a wide-type thermal-transfer printer, in which an ink ribbon can easily be set in position.

The above object of the invention can be achieved by a wide-type thermal-transfer printer which includes a fixed thermal head and prints a record medium being transported relatively to the thermal head by the use of an ink ribbon being transported relatively to the thermal head in substantially the same direction as that of the transportation of the record medium, comprising a fixed mechanism section including a fixed frame, a record medium holder mounted on one end portion of the fixed frame so as to rotatably hold a record medium rolled in the longitudinal direction thereof, and a platen mounted on the other end portion of the fixed frame so as to carry thereon the record medium drawn out from the record medium holder; and a printer unit including a moving frame coupled to the fixed frame so as to be movable between a first position adjacent to the fixed frame and a second position remote from the fixed frame, the moving frame being provided with the thermal head so that the thermal head, in cooperation with the platen, holds the record medium when the moving frame is located in the first position, and so that the thermal head separates from the record medium on the platen to release its joint hold of the medium with the platen when the moving frame is moved from the first position to the second position, wherein the moving frame is detachably fitted with an ink ribbon supply shaft wound with the ink ribbon and an ink ribbon take-up shaft for taking up the ribbon drawn out from the supply shaft, so that the ribbon is held between the platen and the thermal head in a manner such that the longitudinal direction of the ribbon is substantially in line with the transporting direction of the record medium when the moving frame is located in the first position, and wherein the supply and take-up shafts can be attached to and detached from the moving frame when the moving frame is located in the second position, and the thermal head starts printing with the record medium and the ink ribbon being moved in the substantially same direction as that of the transportation of the record medium when the moving frame is located in the first position.

More specifically, the ink ribbon supply and takeup shafts are mounted on the moving frame which can move relatively to the fixed frame of the fixed mechanism section. Therefore, the shafts can freely be accessed with ease without being hindered by the fixed mechanism section after the moving frame of the printer unit is shifted to the moved or second position. Thus, despite its width greater than that of a conventional one, the ink ribbon of the invention can very easily be set in or removed from a predetermined position in the printer.

Moreover, the record medium, unused or new, can freely be drawn out from the record medium holder to the platen, without being hindered by the printer unit, for the first print after the medium is held by the holder.

In the wide-type thermal-transfer printer according to the present invention, it is preferable that the fixed frame of the fixed mechanism section is provided with record medium drive means for drawing out the record medium in the longitudinal direction thereof from the record medium holder and ink ribbon drive means for transporting the ink ribbon from the supply shaft to the take-up shaft when the moving frame is located in the first position. With this arrangement, the relatively weighty components are all arranged in the fixed mechanism section. They include the record medium holder holding the record medium, the ink ribbon drive means usually formed of a motor, and the record medium drive means usually formed of a high-power motor capable of producing a relatively great driving force to draw out the record medium from the record medium holder. Thus, the printer unit is relatively light in total weight. Accordingly, the movement of the printer unit between the fixed (first) and moved (second) positions, especially from fixed (first) position to moved (second) position, requires no great force.

This also facilitates the attachment and detachment of the ink ribbon to and from the printer.

Preferably, in the printer of the invention, the record medium holder and the platen of the fixed mechanism section are located above the lower surface of the printer unit in the first position, and between the record medium holder and the platen the record medium moves along the lower surface of the printer unit in the first position.

With this arrangement, the printer, composed of the fixed mechanism section and printer unit, is reduced in overall height and compact.

In the printer of the invention, moreover, the moving frame of the printer unit is preferably rockably coupled, at that end portion thereof nearer to the record medium holder, to the fixed frame.

With this arrangement, a coupling mechanism for moving the printer unit relatively to the fixed mechanism section between the first and second positions is simple in construction.

In the printer of the invention, moreover, either the fixed frame of the fixed mechanism section or the moving frame of the printer unit preferably includes fixing means for fixing the printer unit to the first position.

With this arrangement, a uniform pressure can securely be applied to the ink ribbon while the printer unit is in the fixed position. Thus, the wide ribbon cannot wrinkle while it is running.

In the printer of the invention, furthermore, a damper is preferably interposed between the printer unit and the fixed frame of the fixed mechanism section, whereby the movement of the printer unit between the first and second positions is made smooth and easy.

The damper not only makes the movement of the printer unit smooth and easy, but also prevents the components of the fixed mechanism section, as well as those of the printer unit, from being damaged by an impact which is produced when the printer unit stops.

An embodiment of the present invention will now be described in detail with reference to the accompanying drawings.

DETAILED DESCRIPTION OF THE PREFERRED EMBODIMENT

Figure 1:
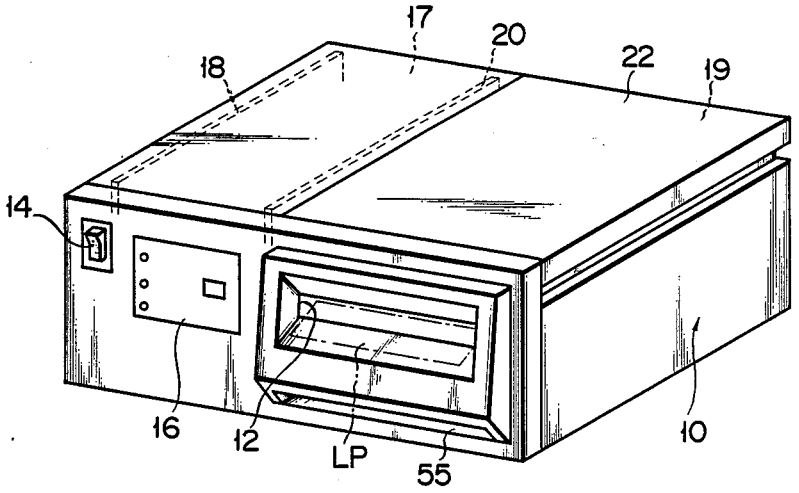
FIG. 1 is a perspective view showing an outline of a wide-type thermal-transfer printer according to an embodiment of the present invention.
Figure 2:
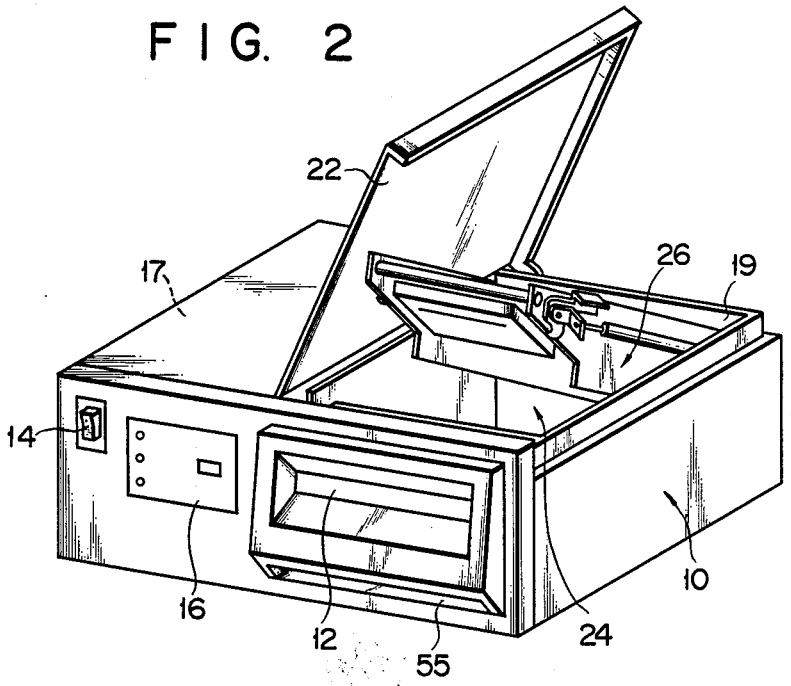
FIG. 2 is a perspective view showing a state in which a top lid of a shell of the printer of FIG. 1 is lifted for replacing an ink ribbon.

In FIGS. 1 and 2, numeral 10 designates a shell of a wide-type thermal-transfer printer. Label outlet slot 12 is formed in the right-hand region of the front face of shell 10. Provided on the left of slot 12 is control panel 16 which carries thereon power switch 14 and various operation buttons and display means.

The inside of shell 10 is divided into two parts, left- and right-hand portions 17 and 19. As shown in FIG. 1, portion 17 contains various electrical components 18, such as a printed circuit board, connected to a host computer (not shown). Portion 19 contains various mechanical components which will be described in detail later. Electric shielding plate 20 is provided between portions 17 and 19 in order to prevent electrical components 18 in portion 17 from being adversely affected by static electricity produced in portion 19.

The right-hand portion of the top face of shell 10, which corresponds to mechanical component containing portion 19, forms swingable lid 22. When lid 22 is lifted, portion 19 is opened or exposed to the outside, as shown in FIG. 2. The mechanical components in portion 19 of shell 10 constitute fixed mechanism section 24 which is fixed to shell 10, and printer unit 26 rockably connected to section 24.

Fixed mechanism section 24 includes record medium holder 28 at the back thereof and fixed frame 30 in front of holder 28.

Figure 3:
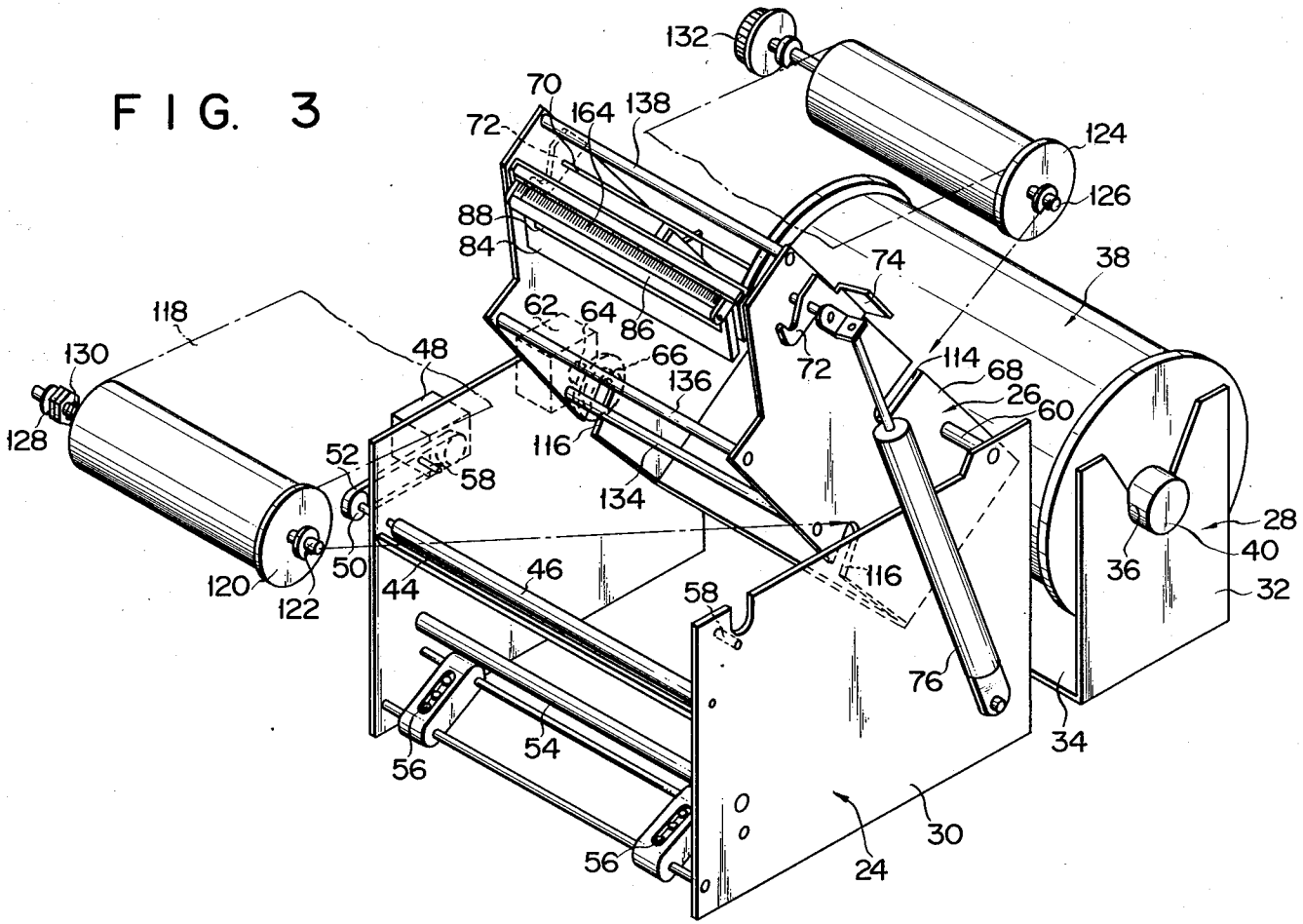
FIG. 3 is a perspective view showing the principal part of the printer of FIG. 1 without the shell, in which a printer unit is located in a moved or second position distant from a fixed mechanism section and adapted for loading or unloading the ink ribbon.
Figure 4:
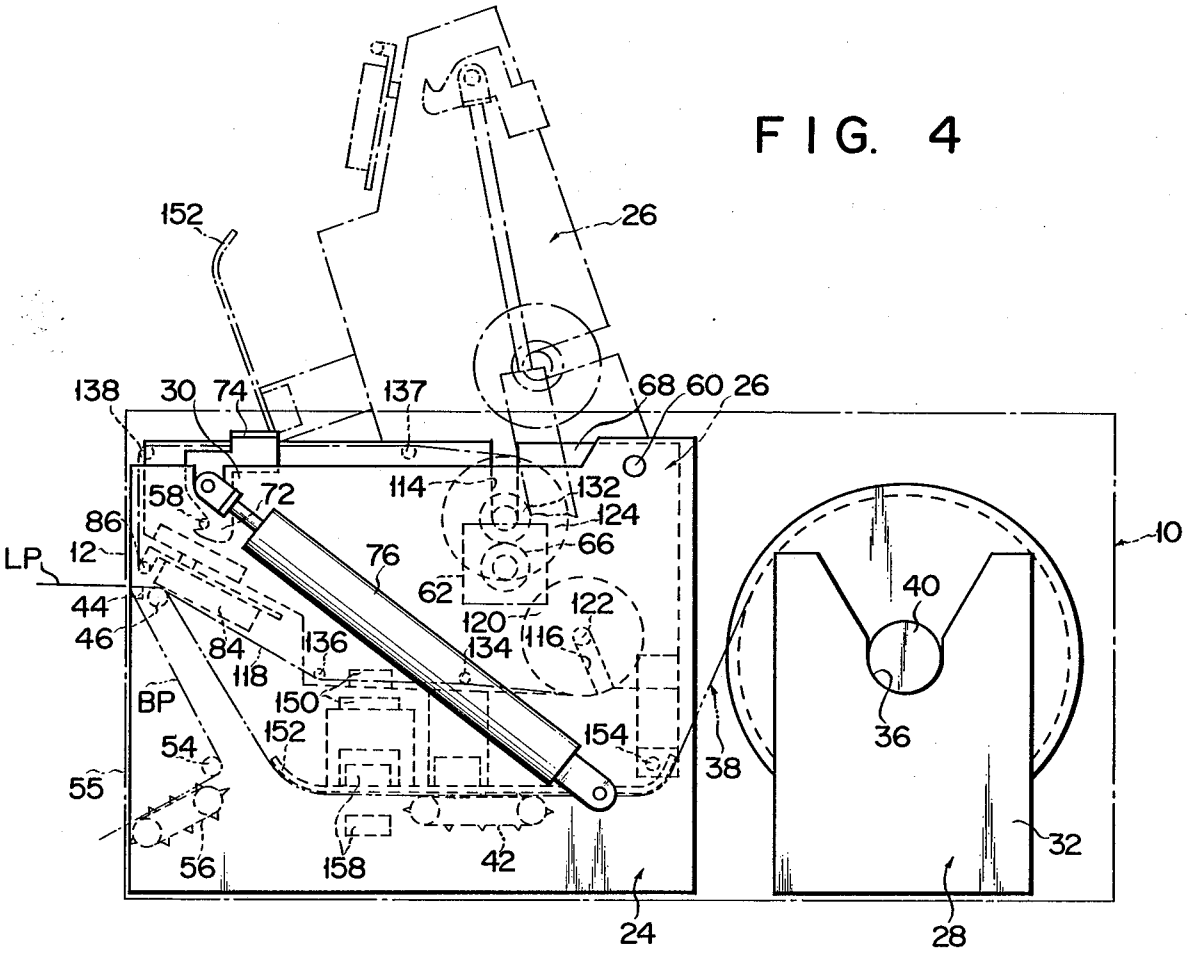
FIG. 4 is a side view schematically showing the principal part of the printer of FIG. 3, in which the printer unit in the moved or second position is indicated by one-dot chain line.
Figure 9:
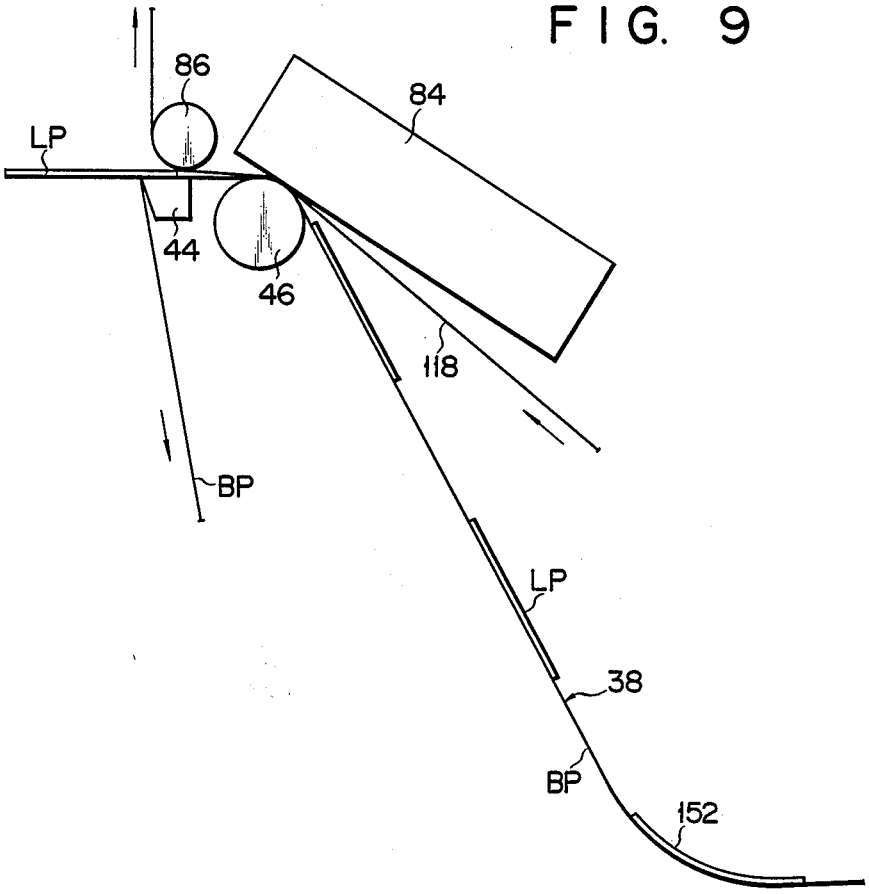
FIG. 9 is a side view schematically showing the way a label sheet as a record medium, a base sheet for the label sheet, and the ink ribbon are separated from one another at a region near thermal head and platen.

As shown in FIGS. 3 and 4, record medium holder 28 includes holder frame 34 having a pair of holder walls 32 which are spaced and horizontally face each other in parallel relation. V-shaped support recess 36 is formed in the top end face of each wall 32 of frame 34. Elongate record medium 38 is wound on a reel. Shaft 40 of the reel is rotatably fitted in each recess 36. In this embodiment, medium 38 is composed of elongate base sheet BP with perforations along its both edges and a number of label sheets LP pasted on sheet BP at predetermined intervals in the longitudinal direction of the base sheet, as shown in FIG. 9. Each label sheet LP, which is formed of ordinary paper (not heatsensitive), is shorter in the longitudinal direction of base sheet BP than in the transverse direction of the base sheet.

A pair of tractors 42 are attached to fixed frame 30, located below shaft 40 of the reel supported by record medium holder 28. The tractors are designed to draw out record medium 38 from the reel without wrinkling it.

Label separating plate 44 is fixed to fixed frame 30 of fixed mechanism section 24, adjoining the lower edge of label outlet slot 12 of shell 10. Rollershaped platen 46 is rotatably mounted in a position just at the back of plate 44. It is connected to platen-drive stepping motor 48 on fixed frame 30 by means of pulley 50 and belt 52. Frame 30 is further fitted with guide shaft 54 which is located below and behind plate 44 and platen 46, and around which the base sheet of record medium 38 delivered from plate 44 and platen 46 is wound to change its course. A pair of tractors 56 are arranged diagonally below shaft 54. They are designed so that the base sheet of medium 38 from shaft 54 can be discharged to the outside through base sheet outlet slot 55 of shell 10 without wrinkling. Base-sheet outlet slot 55 is formed in the lower portion of the front face of shell 10. Motor 48 serves as a drive source for tractors 42 nearer to record medium holder 28 and tractors 56.

Lock pin 58 is fixed to the upper front end portion of the inner surface of each side wall of fixed frame 30. Support shaft 60, as a pivot of printer unit 26, is attached to the upper rear end portion of the inner surface of each side wall of frame 30. Also, ink ribbon drive stepping motor 62 is mounted on the outer surface of the left-hand side wall of frame 30. It serves as a drive source of ink ribbon drive means for driving an ink ribbon which is detachably held in unit 26 in the manner mentioned later. Driving gear 66 is fixed to a projecting end of output shaft 64 of motor 62 which protrudes from the outside of the left-hand side wall of frame 30 to the inside thereof.

Figure 5:
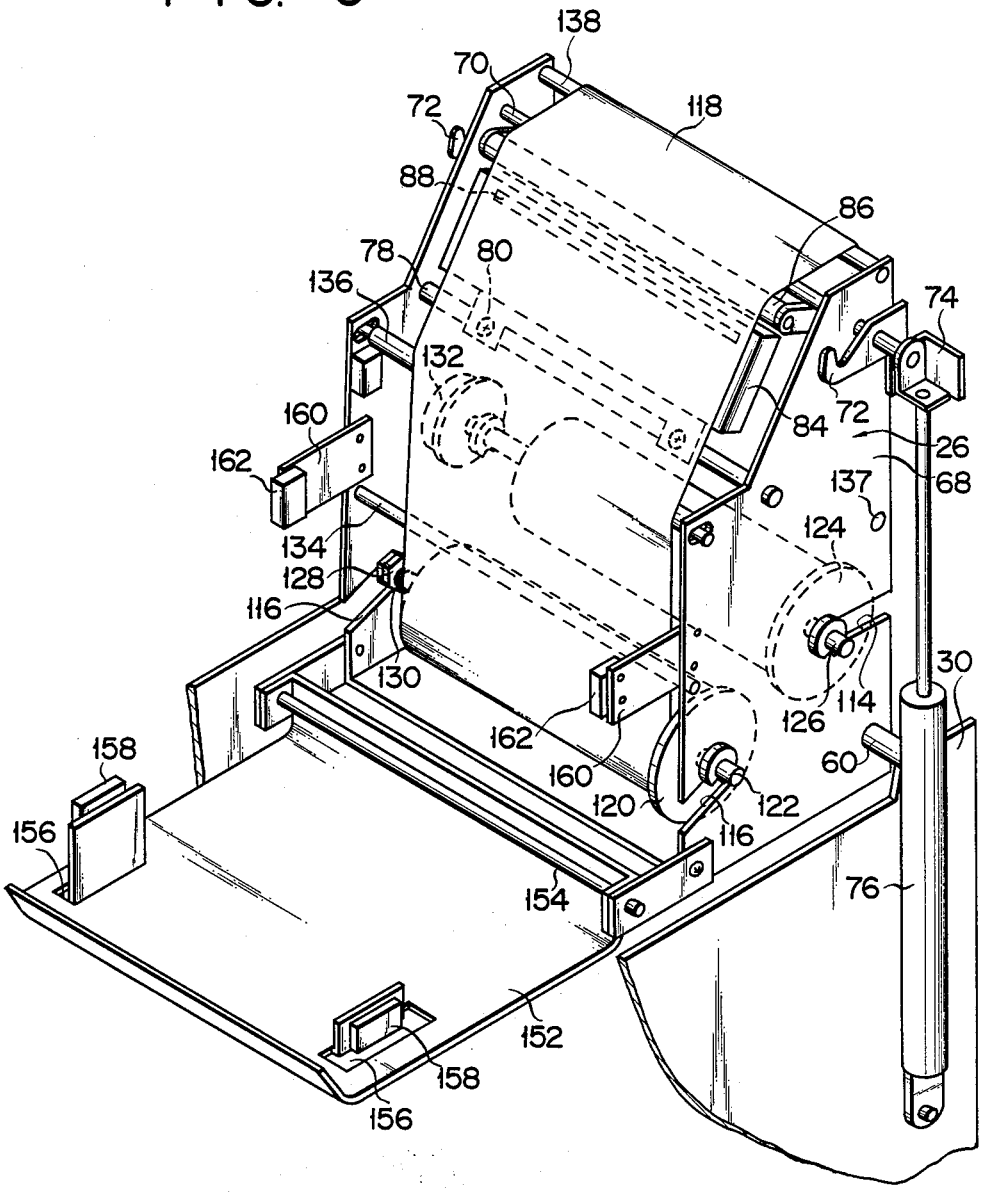
FIG. 5 is a perspective view schematically showing the printer unit located in the moved or second position for replacing the ink ribbon.

As shown in FIGS. 3 to 5, moving frame 68 of printer unit 26 is mounted on support shafts 60 so that unit 26 is rockable around the shafts. Hook support shaft 70 is stretched between the upper front end portions of two side walls of frame 68. Lock hook 72 is fixed to each end of shaft 70 which projects outward from its corresponding side wall of frame 68. Hooks 72 are adapted to engage their corresponding lock pins 58 of fixed frame 30 of fixed mechanism section 24 when printer unit 26 is located in its fixed position. One of the paired lock hooks is formed with knob portion 74, which is handled in rotating hooks 72 to engage or disengage them with or from pins 58.

One end of damper 76 is fixed to the outer end portion of hook support shaft 70. The damper serves to prevent printer unit 26 from moving suddenly and ease an impact which is produced when the unit stops. The other end of damper 76 is attached to fixed frame 30 of fixed mechanism section 24.

Figure 6:
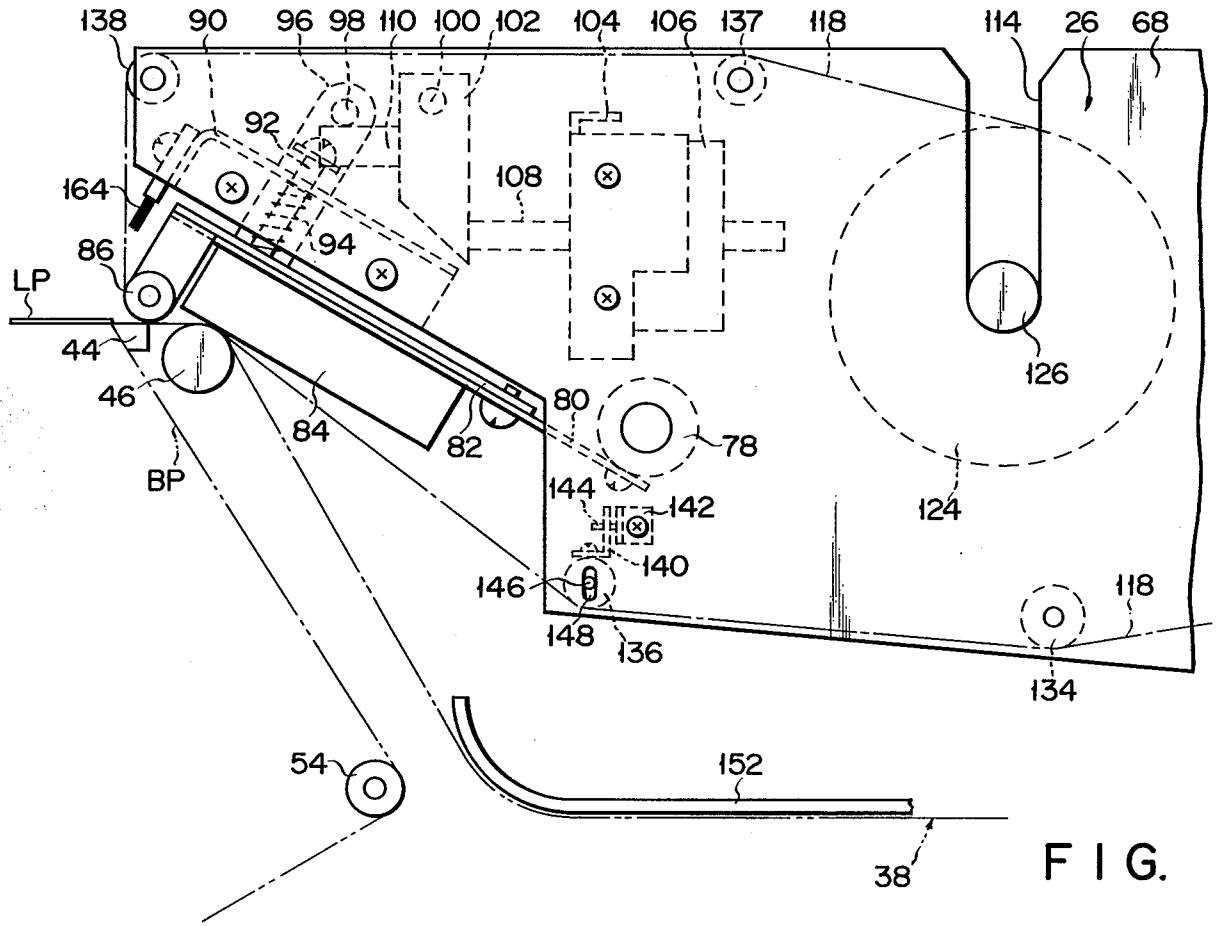
FIG. 6 is a side view schematically showing a neighborhood of thermal head and platen of the principal part of the printer.

In the vicinity of hook support shaft 70, head support shaft 78 is stretched between both side walls of moving frame 68. As shown in FIG. 6, head holder plate 82 is mounted on shaft 78 by means of leaf spring 80. Thermal head 84 and ink ribbon guide roller 86 are attached to holder plate 82. Head 84 is longer in the transverse direction of printer unit 26 than in the longitudinal direction of the unit. It substantially covers the whole transverse length of plate 82. Roller 86, which is located in front of head 84, serves to guide the ink ribbon along its course. As shown in FIG. 5, heat generator 88 is disposed on thermal head 84, substantially covering the whole transverse length of the head. Above holder plate 82, as shown in FIG. 6, spring holder plate 90 is attached to moving frame 68. Guide shaft 92, which is fixed to plate 82, slidably engages plate 90. Shaft 92 is wound with compression coil spring 94 which is held between plates 90 and 82. Spring 94 urges head 84 downward.

Figure 7:
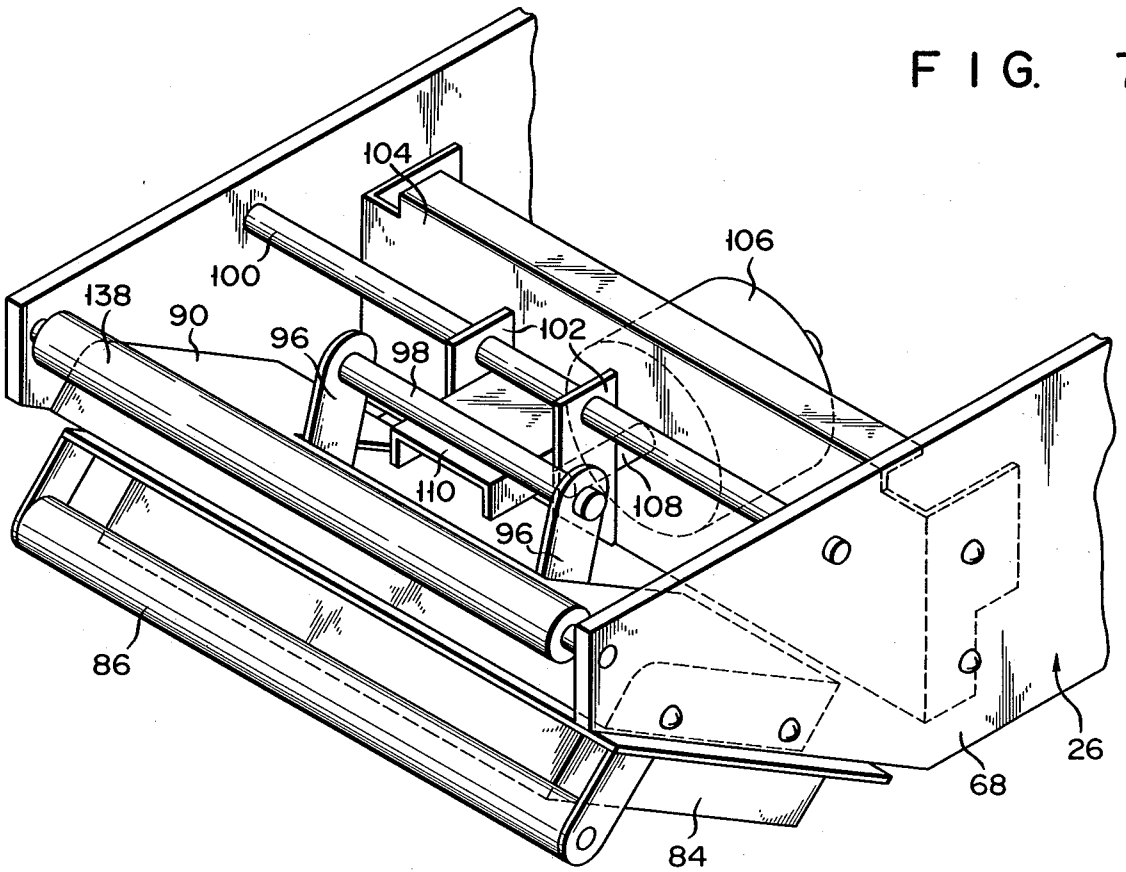
FIG. 7 is a perspective view schematically showing a neighborhood of the thermal head of the printer unit to show a head-up mechanism for lifting the head.

As shown in FIGS. 6 and 7, a pair of upwardly projecting members 96 are formed integrally with head holder plate 82. They project above spring holder plate 90 through an opening therein. Two ends of horizontally extending engaging pin 98 are fixed individually to the respective projecting end portions of members 96. Swing arm 102 is rockably mounted on support shaft 100 both ends of which are fixed to their corresponding side walls of moving frame 68 at the back of pin 98. The front end portion of movable core 108 of solenoid means 106 abuts against the lower end portion of arm 102. The solenoid means is held by solenoid holder plate 104 which is fixed to both side walls of frame 68 at the back of arm 102.

Forwardly extending portion 110 is fixed to swing arm 102 so as to be in contact with the bottom side of engaging pin 98 which is fixed to upwardly projecting members 96 on head holder plate 82. Solenoid means 106, arm 102, pin 98, and members 96 constitute a head-up mechanism for alternatively moving thermal head 84 up or down.

At the back of solenoid means 106, shaft support slit 114 is formed in the upper edge of each side wall of moving frame 68. Near the rear end portion of frame 68, another shaft support slit 116 is formed in the lower edge of each side wall of frame 68. Each end of shaft 122 of ink ribbon supply reel 120 is removably fitted in lower slit 116 to be supported thereby for rotation. Reel 120 is wound with ink ribbon 118 for thermal transfer whose width is substantially equal to the transverse length or width of thermal head 84. Each end of shaft 126 of ink ribbon take-up reel 124 is fitted in upper slit 114 to be supported thereby for rotation. Reel 124 serves to take up ribbon 118 which is drawn out from supply reel 120.

Hexagonal fixed plate 128 is mounted on one end portion of shaft 122 of supply reel 120 for rotation and axial slide. It is removably attached to the inner surface of the corresponding side wall of moving frame 68. Spring 130 for back-tension adjustment is wound on shaft 122 between plate 128 and reel 120. Moreover, driven gear 132 is fixed to one end portion of shaft 126 of take-up reel 124. When printer unit 26 is located in its fixed or first position, gear 132 engages driving gear 66 which is fixed to output shaft 64 of ink ribbon drive stepping motor 62.

Figure 8:
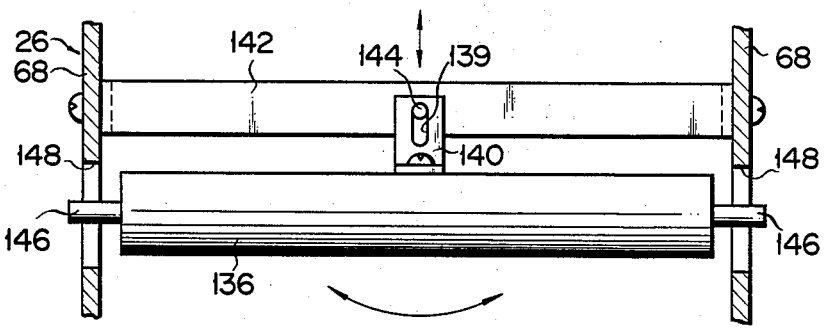
FIG. 8 is a schematic front view of a balancer of the printer unit for the ink ribbon.

Guide roller 134 and balancer roller 136 are successively arranged in front of lower shaft support slit 116. The ends of these rollers are held by the lower edge portions of both side walls of moving frame 68. Also, two guide rollers 137 and 138 are successively arranged in front of upper shaft support slit 114, having their ends held by the upper edge portions of both side walls of frame 68. As shown in FIGS. 6 and 8, hanger plate 140 is fixed to the middle portion of balancer roller 136. It is formed with vertically extending slot 139. Hanger pin 144, which protrudes forward from the middle portion of balancer roller support rod 142, is inserted in slot 139. Both ends of rod 142 are fixed to the side walls of frame 68. Guide pin 146 is fixed to each end of roller 136, projecting toward its corresponding side wall of frame 68. It is inserted in vertically extending guide slot 148 which is formed in each side wall of frame 68. Mounted in this manner, balancer roller 136 depresses ink ribbon 118 by its own weight after the ribbon is drawn out from ink ribbon supply reel 120. Thus, if the tension of ribbon 118 at one end varies from that at the other end, roller 136 inclines or rocks around hanger pin 144, thereby eliminating the imbalance of tension in the ribbon.

As shown in FIG. 4, moving frame 68 is further provided with ink ribbon detector 150 for optically detecting the presence of ink ribbon 118 between balancer roller 136 and guide roller 134 at the lower edge of frame 68.

Record medium guide plate 152 is disposed along the lower edges of both side walls of moving frame 68. As shown in FIG. 5, it is rockably mounted on guide plate support shaft 154 which is fixed at both ends to the rear end portions of the lower edges of the side walls of frame 68. Light apertures 156 are bored through the front end portions of the side edges of guide plate 152. Part of label detector 158 is attached to plate 152 so as to be located in apertures 156. Detector 158 optically detects the presence of label sheet LP on record medium 38 moving along plate 152. The remaining part of detector 158, as shown in FIG. 4, is attached to fixed frame 30 of fixed mechanism section 24 so as to face label detector 158 on the printer unit side when printer unit 26 is located in its fixed or first position. Guide plate 152, which is formed of ferromagnetic material such as iron, is fixed along the lower edges of the side walls of moving frame 68 of unit 26 by being attracted to magnets 162. The magnets are supported individually by magnet support plates 160 which are fixed to the lower side wall edges of moving frame 68, protruding downward therefrom.

De-electrification brush 164, formed of a carbon brush or the like, is fixed in front of head holder plate 82. It is designed to touch ink ribbon 118 between ink ribbon guide roller 86 and guide roller 138, thereby removing static electricity from the ribbon.

In the embodiment described above, as shown in FIG. 4, the bottom or record medium guide plate 152 of printer unit 26 in the fixed or first position is located below shaft 40 of the reel which is wound with record medium 38 and held by record medium holder 28 of fixed mechanism section 34. Thus, shell 10 can be reduced in height. Record medium 38, drawn out from holder 28, is pressed by guide plate 152 of unit 26 in the fixed or first position so that the perforations along both edges of medium 38 engage first paired tractors 42. Then, medium 38 is put on platen 46 and label separating plate 44, fed to second paired tractors 56 by guide shaft 54, and discharged from shell 10 through base-sheet outlet slot 55. Meanwhile, ink ribbon 118, drawn out from ink ribbon supply reel 120, is transported past guide roller 134 and balancer roller 136, and joined with record medium 38 on platen 46 by thermal head 84. Thereafter, the ribbon is fed past ink ribbon roller 86 and guide rollers 138 and 137, and then taken up by ink ribbon take-up reel 124.

Figure 10:
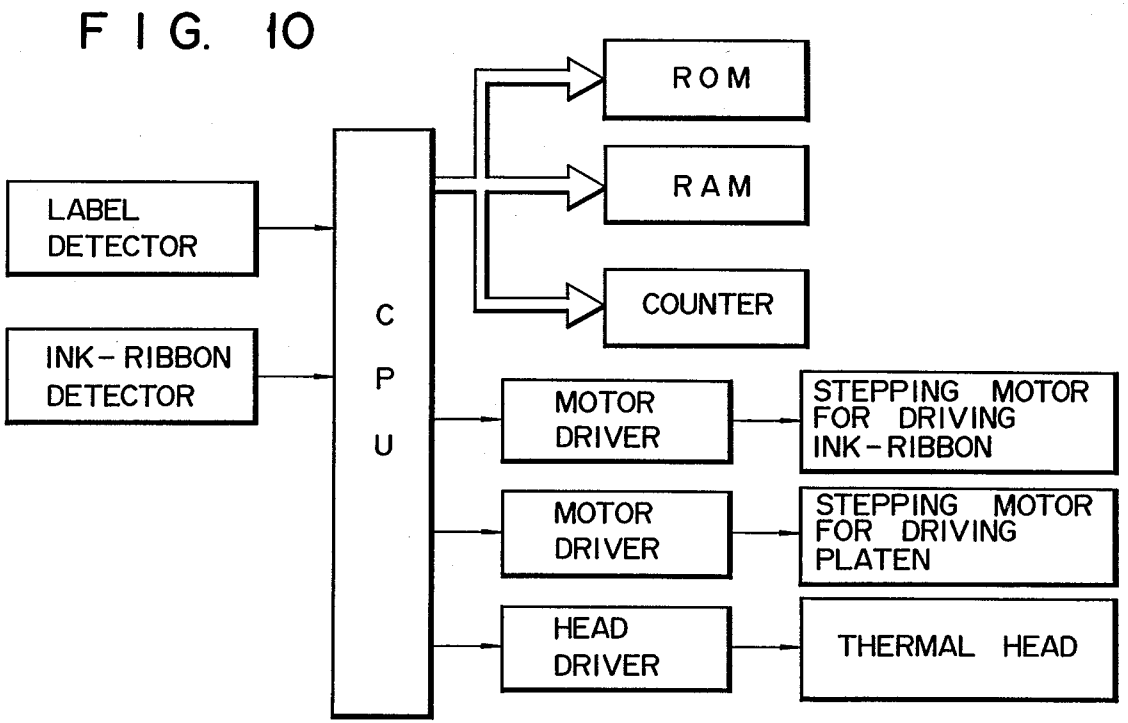
FIG. 10 is a block diagram of an electrical system of the printer.

FIG. 10 is a block diagram of an electrical system for controlling the operation of the wide-type thermaltransfer printer according to the embodiment described above.

In FIG. 10, the label detector and ink ribbon detector are connected to a CPU, which is coupled to a ROM, RAM, counter, motor drivers for stepping motors used to drive ink ribbon and platen, individually, and head driver for thermal head.

Figure 11:
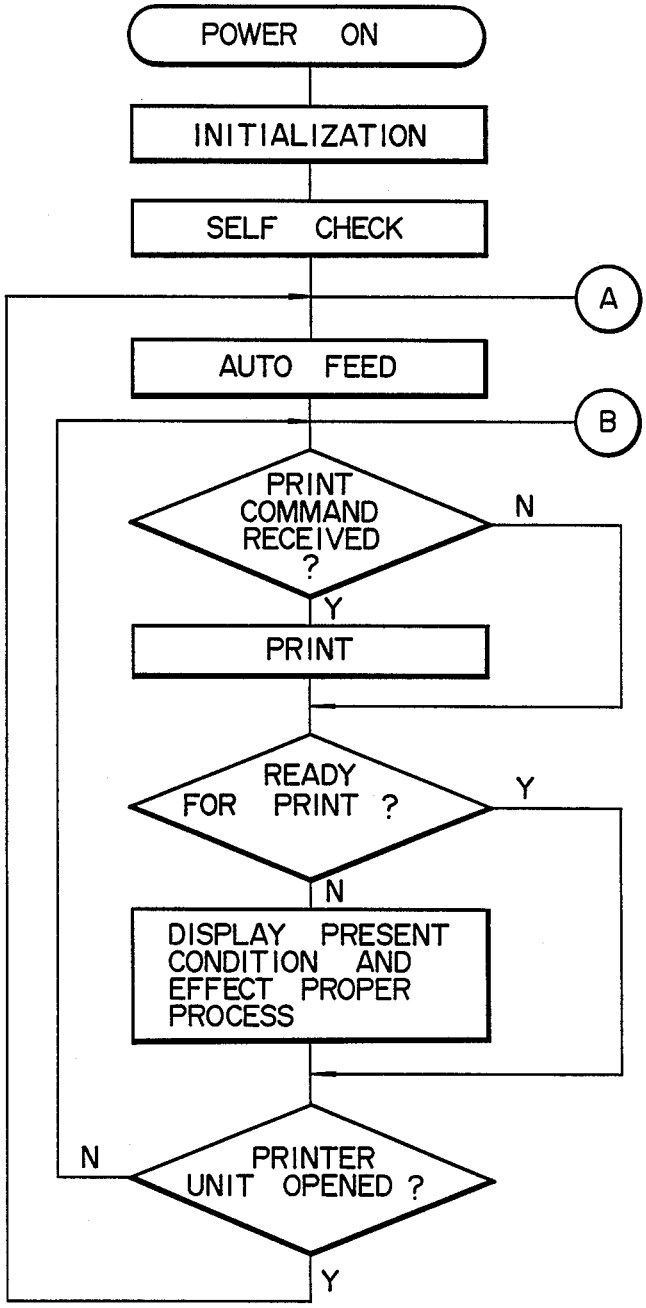
FIG. 11 is a flow chart illustrating the operation of the printer.
Figure 12:
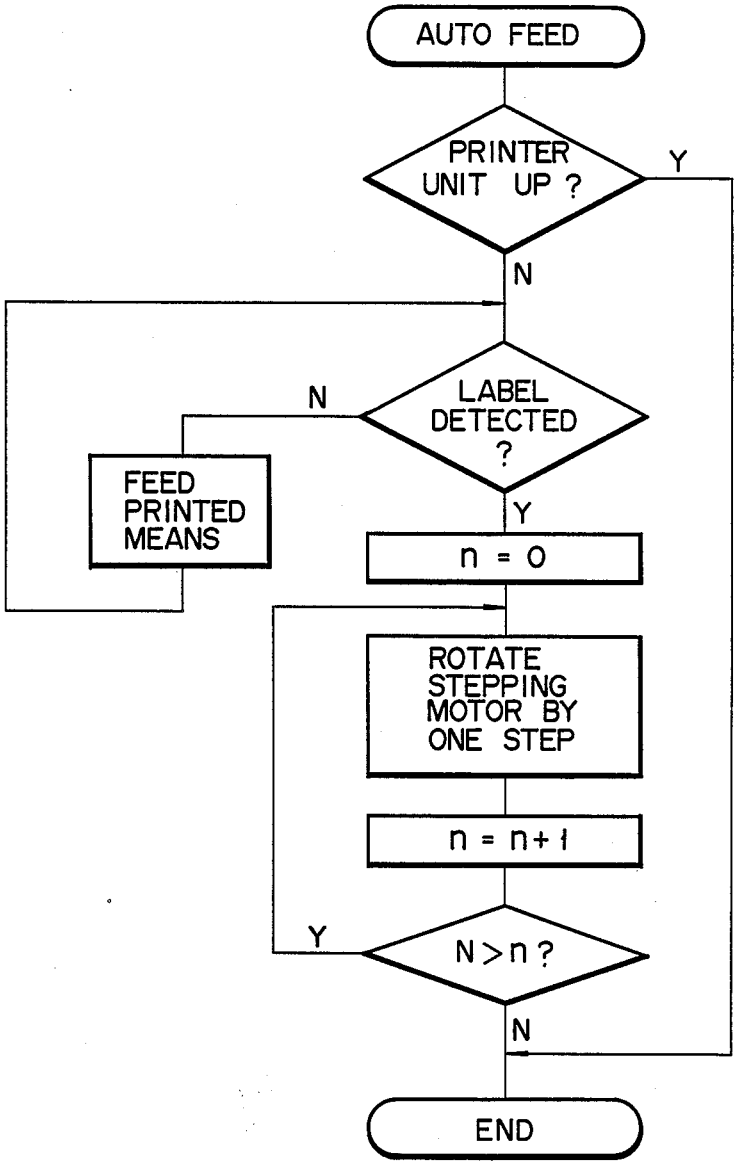
FIG. 12 is a detailed flow chart illustrating the autofeed process in the flow chart of FIG. 11.

Referring now to FIGS. 11 and 12, the operation of the electrical system will be described in detail.

Record medium 38 is located in a predetermined position in fixed mechanism section 24, ink ribbon 118 is positioned in place in printer unit 26, and unit 26 is located in its fixed or first position. In this state, when the power is turned on, various LSIs are initialized, and the RAM is cleared and initialized for constant and other items. Then, various self-checks are made, including checks of ROM and RAM and disconnection check on heat generator 88 of thermal head 84, and point A is reached. Thereafter, record medium 38 is automatically fed, and label detection is effected by label detector 158.

When label detector 158 detects the leading edge of label sheet LP, the steps of platen-drive stepping motor 48 start to be counted from zero. When count number n attains a value equivalent to distance N which corresponds to the reach of each two label sheets LP on base sheet BP, motor 48 is stopped.

In a stationary state, thermal head 84 is always in contact with that portion of record medium 38 which carries no label sheet LP. Thus, ink of ink ribbon 118 is prevented from being transferred to sheet LP to leave streaks thereon before the start of a desired print.

After the end of the auto-feed process shown in the detail flow chart of FIG. 12, point B of FIG. 11 is reached, and a print command from the host computer is awaited. Before the print command is given, the printer continues to be monitored for trouble check. Malfunction of the printer, if any, is displayed.

When the print command is delivered, thermal head 84 produces a print correspondingly, and the printer is checked for error. Immediately when printer unit 26 is shifted to its moved position or open position, point A of FIG. 11 is resumed. When unit 26 is shifted again to its fixed position or closed position, record medium 38 is automatically fed for the distance corresponding to the reach of two label sheets.

The feed of record medium 38 is effected by means of tractors 42 and 56, and its speed, based on the rotation of platen 46, is controlled accurately for printing. The feed of medium 38 by tracks 42 nearer to record medium holder 28 facilitates the feed by platen 46. The feed of base sheet BP of medium 38 by tractors 56, on the lower-course side of the flow of the medium as compared with platen 46 and label separating plate 44, ensures the separation of label sheet P from base sheet BP after printing. The separation is caused when sheet BP suddenly changes its course at plate 44. During the printing operation, ink ribbon drive motor 62 rotates so that ink ribbon take-up reel 124 is rotated through the medium of driving gear 66 and driven gear 132. Thus, ink ribbon 118 is compulsorily wound from ink ribbon supply reel 120. This compulsory winding ensures the separation between ribbon 118 and label sheet LP after printing even though the ribbon adheres to the sheet during the transfer of the ink between the two.

Since heat from heat generator 88 of thermal head 84 is applied unevenly to ink ribbon 188 with respect to the width of the ribbon, thermal deformation of the ribbon is uneven across the width. Accordingly, ribbon 188 is subject to a local transverse deformation at the nip or contact region between platen 46 and heat generator 88 of head 84. As ribbon 118 continues to be fed, the deformation is extended, so that the ribbon suffers wrinkling before it reaches head 84. To prevent this, solenoid means 106 is energized periodically in the middle of printing or during a predetermined resting period.

Thus, the head-up mechanism, including movable core 108, swing arm 102 and upwardly projecting members 96, is caused to raise head holder plate 82, so that head 84 is instantaneously lifted above platen 46. The lift of the thermal head makes ink ribbon 118 free. Pulled by take-up reel 124, the freed ribbon is cleared of the local thermal deformation, i.e., cause of wrinkling.

A process of resupply of record medium 38 will now be described. First, top lid 22 of shell 10 is lifted, and knob portion 74 of one of lock hooks 72 of printer unit 26 is handled to disengage hooks 72 from their corresponding lock pins 58 of fixed mechanism section 24. When unit 26 is then rotated around support shaft 60 or lifted to its moved or second position or open position, record medium guide plate 152 also moves upward. As a result, the mechanism located between record medium holder 28 and platen 46 is exposed to the outside space. Thus, record medium 38 can be loaded without being hindered by printer unit 26. The loading of the record medium includes steps of setting the rolled medium in holder 28, placing on platen 46 that portion of medium 38 drawn out from holder 28, and then passing it under guide shaft 54 to cause it to engage tractors 56 beside base-sheet outlet slot 55. After the loading, printer unit 26 is rotated to its fixed or first position or closed position to cause lock hooks 72 to engage lock pins 58. Thereupon, record medium 38 extending between holder 28 and platen 46 is depressed by guide plate 152 of unit 26 to engage tractors 42 nearer to holder 28. The engagement between lock pins 58, on both side walls of fixed frame 30 of fixed mechanism section 24, and lock hooks 72, on both side walls of moving frame 68 of printer unit 26, makes the contact pressure between thermal head 84 and platen 46 uniform with respect to the transverse direction. Thus, ink ribbon 118 and record medium 38 can be fed at a uniform speed across the width.

A process of replacing ink ribbon 118 will now be described. Also in this case, printer unit 26 is first rotated to the moved or open position. Then, record medium guide plate 152, which has so far been attracted to moving frame 68 of unit 26 by magnets 162, is rocked around guide plate support shaft 154 to take the horizontal position as shown in FIG. 5. As a result, there are no obstacles to hinder the attachment or detachment of supply and take-up reels 120 and 124 to or from shaft support slits 116 and 114 of moving frame 68. Thus, reels 120 and 124 can easily be mounted in or removed from the predetermined positions of printer unit 26.

Moving frame 68 of printer unit 26, rocking between the fixed (first) and moved (second) positions, is not mounted with any weighty members, such as the stepping motors used to drive platen and ribbon. Therefore, unit 26 is relatively light in weight, and its movement between the two positions requires no great force. Since damper 76 is provided between fixed mechanism section 24 and printer unit 26, moreover, thermal head 84 is prevented from heavily running against platen 46 when unit 26 is shifted to the fixed position. Thus, generator 88 and other members can effectively be protected from damage due to an impact produced when unit 26 stops.

What is claimed is:

1. A wide-type thermal-transfer printer which includes a fixed thermal head and prints a record medium being transported relatively to the thermal head by the use of an ink ribbon being transported relatively to the thermal head in substantially the same direction as that of the transportation of the record medium, comprsing:

a fixed mechanism section including a fixed frame, a record medium holder mounted on the fixed frame adapted to rotatably hold a record medium rolled in the longitudinal direction thereof, and a platen mounted on the fixed frame adapted to carry thereon the record medium drawn out from the record medium holder; and a printer unit including a moving frame coupled to the fixed frame so as to have at least a portion thereof movable between a first position adjacent to the fixed frame and a second position remote from the fixed frame, a thermal head mounted on the moving frame, the record medium being held between the platen and the thermal head when the moving frame is located in the first position, and the record medium being released from between the platen and the thermal head when the moving frame is moved from the first position to the second position, an ink ribbon supply shaft detachably mounted on said moving frame and wound with the ink ribbon, and an ink ribbon take-up shaft mounted on said moving frame for taking up the ribbon drawn out from the supply shaft, the ink ribbon being held between the platen and the thermal head such that the longitudinal direction of the ink ribbon is substantially in line with the transporting direction of the record medium when the moving frame is located in the first position, and said record medium holder and said platen of the fixed mechanism section are located above a lower surface of the printer unit, and said record medium extending between the record medium holder and said platen and located along the lower surface of said printer unit when the moving frame is in its first position, and wherein said take-up shaft can be attached to and detached from the moving frame when the moving frame is located in the second position, and said thermal head starts printing with the record medium and the ink ribbon being moved in substantially the same direction as that of the transportation of the record medium when the moving frame is located in the first position.

2. The wide-type thermal-transfer printer according to claim 1, wherein said fixed frame of said fixed mechanism section is provided with record medium drive means for drawing out the record medium in the longitudinal direction thereof from the record medium holder and ink ribbon drive means for transporting the ink ribbon from the supply shaft to the take-up shaft when the moving frame is located in the first position.

3. The wide-type thermal-transfer printer according to claim 1, wherein said moving frame of the printer unit is rockably coupled, at that end portion thereof nearer to the record medium holder, to the fixed frame.

4. The wide-type thermal-transfer printer according to claim 3, wherein said fixed frame of said fixed mechanism section is provided with record medium drive means for drawing out the record medium in the longitudinal direction thereof from the record medium holder and ink ribbon drive means for transporting the ink ribbon from the supply shaft to the take-up shaft when the moving frame is located in the first position.

5. The wide-type thermal-transfer printer according to claim 1, wherein at least one of said fixed frame of the fixed mechanism section and said moving frame of the printer unit includes fixing means for fixing the printer unit tot he first position.

6. The wide-type thermal-transfer printer according to claim 5, wherein said fixed frame of said fixed mechanism section is provided with record medium drive means for drawing out the record medium in the longitudinal direction thereof from the record medium holder and ink ribbon drive means for transporting the ink ribbon from the supply shaft to the take-up shaft when the moving frame is located in the first position.

7. The wide-type thermal-transfer printer according to claim 8, wherein said moving frame of the printer unit is rockably coupled, at that end portion thereof nearer to the record medium holder, to the fixed frame.

8. The wide-type thermal-transfer printer according to claim 1, wherein a damper is interposed between said printer unit and said fixed frame of the fixed mechanism section, whereby the movement of the printer unit between the first and second positions is made smooth and easy.

9. The wide-type thermal-transfer printer according to claim 12, wherein said fixed frame of said fixed mechanism section is provided with record medium drive means for drawing out the record medium in the longitudinal direction thereof from the record medium holder and ink ribbon drive means for transporting the ink ribbon from the supply shaft to the take-up shaft when the moving frame is located in the first position.

10. The wide-type thermal-transfer printer according to claim 8, wherein said moving frame of the printer unit is rockably coupled, at that end portion thereof nearer to the record medium holder, to the fixed frame.

11. The wide-type thermal-transfer printer according to claim 8, wherein at least one of said fixed frame of the fixed mechanism section and said moving frame of the printer unit includes fixing means for fixing the printer unit to the first position.

12. The wide-type thermal-transfer printer according to claim 1, wherein said ink ribbon take-up shaft is detachably mounted on said moving frame, said ink ribbon take-up shaft being attachable to and detachable from the moving frame when the moving frame is located in the second position.

13. A wide-type thermal-transfer printer which includes a fixed thermal head and prints a record medium being transported relatively to the thermal head by the use of an ink ribbon being transported relatively tot he thermal head in substantially the same direction as that of the transportation of the record medium, comprising:

a fixed mechanism section including a fixed frame, a record medium holder mounted on the fixed frame adapted to rotatably hold a record medium rolled in the longitudinal direction thereof, and a platen mounted on the fixed frame adapted to carry thereon the record medium drawn out from the record medium holder; and a printer unit including a moving frame coupled to the fixed frame so as to have at least a portion thereof movable between a first position adjacent to the fixed frame and a second position remote from the fixed frame, a thermal head mounted on the moving frame, the record medium being held between the platen and the thermal head when the moving frame is located in the first position, and the record medium being released from between the platen and the thermal head when the moving frame is moved from the first position to the second position, an ink ribbon supply shaft detachably mounted on said moving frame and wound with the ink ribbon, and an ink ribbon take-up shaft mounted on said moving frame for taking up the ribbon drawn out from the supply shaft, the ink ribbon being held between the platen and the thermal head such that the longitudinal direction of the ink ribbon is substantially in line with the transporting direction of the record medium when the moving frame is located in the first position, and a record mediudm guide plate mounted on the moving frame so as to be movable between a closed position and an open position whereby, in its closed position, the guide plate covers a lower end of said printer unit and defines a lower end surface of the printer unit and, in its open position, at least a portion of the guide plate is spaced from the printer unit to open said lower end thereof, said guide plate being in its closed position when the moving frame is in its first position and, when the moving frame is in its second position, said guide plate being movable between its said open and closed positions to enable attachment and detachment of the ink ribbon supply shaft to and from said moving frame when the guide plate is in its open position, and said guide plate preventing the ink ribbon supply shaft from detaching from said moving frame when said plate is in its closed position, said record medium holder and said platen of the fixed mechanism section are located above a guide plate of the printer unit and said record medium extending between the record medium holder and said platen and located along the guide plate of said printer unit when the moving frame is in its first position, and wherein said take-up shaft can be attached to and detached from the moving frame when the moving frame is located in the second position, and said thermal head starts printing with the record medium and the ink ribbon being moved in substantially the same direction as that of the transportation of the record medium when the moving frame is located in the first position.

14. The wide-type thermal-transfer printer according to claim 13, wherein said fixed frame of said fixed mechanism section is provided with record medium drive means for drawing out the record medium in the longitudinal direction thereof from the record medium holder and ink ribbon drive means for transporting the ink ribbon from the supply shaft to the take-up shaft when the moving frame is located in the first position.

15. The wide-type thermal-transfer printer according to claim 13, wherein said moving frame of the printer unit is rockably coupled, at that end portion thereof nearer to the record medium holder, to the fixed frame.

16. The wide-type thermal-transfer printing according to claim 13, wherein at least one of said fixed frame of the fixed mechanism section and said moving frame of the printer unit includes fixing means for fixing the printer unit to the first position.

17. The wide-type thermal-transfer printing according to claim 13, wherein said ink ribbon take-up shaft is detachably mounted on said moving frame, said ink ribbon take-up shaft being attachable to and detachable from the moving frame when the moving frame is located in the second position and said guide plate is in its open position.

18. A wide-type thermal-transfer printer which includes a fixed thermal head and prints a record medium being transported relatively to the thermal head by the use of an ink ribbon being transported relatively to the thermal head in substantially the same direction as that of the transportation of the record medium, comprising:

a fixed frame, a record medium holder mounted on the fixed frame adapted to rotatably hold a record medium rolled in the longitudinal direction thereof, and a platen mounted on the fixed frame adapted to carry thereon the record medium drawn out from the record medium holder; and a moving frame coupled to the fixed frame so as to have at least a portion thereof movable between a first position adjacent to the fixed frame and a second position remote from the fixed frame, a thermal head mounted on the moving frame, the record medium being held between the platen and the thermal head when the moving frame is located in the first position, and the record medium being released from between the platen and the thermal head when the moving frame is moved from the first position to the second position, an ink ribbon supply shaft detachably mounted on said moving frame and wound with the ink ribbon, and an ink ribbon take-up shaft mounted on said moving frame for taking up the ribbon drawn out from the supply shaft, the ink ribbon being held between the platen and the thermal head such that the longitudinal direction of the ink ribbon is substantially in line with the transporting direction of the record medium when the moving frame is located in the first position, and said record medium holder and said platen of the fixed mechanism section are located above a lower surface of the printer unit, and said record medium extending between the record medium holder and said platen and located along the lower surface of said printer unit when the moving frame is in its first position, wherein said take-up shaft can be attached to and detached from the moving frame when the moving frame is located in the second position, and said thermal head starts printing with the record medium and the ink ribbon being moved in substantially the same direction as that of the transpsortation of the record medium when the moving frame is located in the first position, and means coucpled to the fixed mechanism section for separating the label sheets from the base sheet following printing of the label sheets while they are still carried on the base sheet.

19. The wide-type thermal-transfer printer according to claim 18, wherein said record medium holder and said platen of the fixed mechanism section are located above a lower surface of the printer unit, and said record medium extending between the record medium holder and said platen and located along the lower surface of said printer unit when the moving frame is in its first position.

20. The wide-type thermal-transfer printer according to claim 18, wherein said moving frame of the printer unit is rockably coupled, at that end portion thereof nearer to the record medium holder, to the fixed frame.

21. The wide-type thermal-transfer printing according to claim 18, wherein at least one of said fixed frame of the fixed mechanism section and said moving frame of the printer unit includes fixing means for fixing the printer unit to the first position.

22. The wide-type thermal-transfer printer according to claim 18, wherein a damper is interposed between said printer unit and said fixed frame of the fixed mechanism section, whereby the movement of the printer unit between the first and second positions is made smooth and easy.

23. The wide-type thermal-transfer printer according to claim 18, wherein said fixed frame of said fixed mechanism section is provided with record medium dreive means for drawing out the record medium in the longitudinal direction thereof from the record medium holder, ink ribbon drive means for transporting the ink ribbon from the supply shaft to the take-up shaft when the moving frame is located in the first position, and the label sheet separating means mounted on the fixed frame.

* * * * *